United States Patent [19]

Murakami et al.

[11] 4,391,635

[45] Jul. 5, 1983

[54] HIGH CR LOW NI TWO-PHASED CAST STAINLESS STEEL

[75] Inventors: Shinichi Murakami, Osaka; Toshiaki Morichika, Hirakata; Hisashi Hiraishi, Yawata; Hiroyuki Shiokawa, Osaka, all of Japan

[73] Assignee: Kubota, Ltd., Osaka, Japan

[21] Appl. No.: 280,237

[22] Filed: Jul. 6, 1981

Related U.S. Application Data

[63] Continuation of Ser. No. 189,335, Sep. 22, 1980, abandoned.

[51] Int. Cl.[3] ..... C22C 38/42; C22C 38/48

[52] U.S. Cl. ..... 75/125; 75/128 G; 148/37

[58] Field of Search ..... 75/128 G, 128 W, 126 B, 75/125; 148/37

[56] References Cited

U.S. PATENT DOCUMENTS

| | | | |
|---|---|---|---|
| 3,567,434 | 3/1971 | Richardson et al. | 75/125 |
| 3,740,213 | 6/1973 | Hellner et al. | 75/128 G |
| 4,047,941 | 9/1977 | Wright | 75/126 B |
| 4,055,448 | 10/1977 | Fujikura et al. | 75/128 W |
| 4,141,762 | 2/1979 | Yamaguchi et al. | 75/128 G |
| 4,172,716 | 10/1979 | Abo et al. | 75/128 G |

FOREIGN PATENT DOCUMENTS

| | | | |
|---|---|---|---|
| 1089824 | 11/1967 | United Kingdom | 75/128 G |
| 589280 | 1/1978 | U.S.S.R. | 75/128 G |

OTHER PUBLICATIONS

Standard Specification for Corrosion-Resistant Iron--Chromium, Iron-Chromium-Nickel and Nickel-Base Alloy Castings for General Application ANSI/ASTM A296-77, pp. 143, 147-150.

ACI Data Sheet, "Corrosion Resistant Type CD-4MCu", Steel Founder's Society of America, Jan. 1973.

"Standard Stainless and Heat Resisting Steels", Metal Progress, Mid-Jun. 1980, p. 38.

*Primary Examiner*—Peter K. Skiff

*Attorney, Agent, or Firm*—Armstrong, Nikaido, Marmelstein & Kubovcik

[57] ABSTRACT

Ferrite-austenitic two-phased stainless steel with high corrosion resistance and toughness containing the following, which may be manufactured easily by furnace melting in the atmosphere composition (by weight %)

| | |
|---|---|
| C | less than 0.10% |
| Si | less than 1.5% |
| Mn | less than 1.5% |
| P | less than 0.04% |
| S | less than 0.04% |
| Cr | 22-30% |
| Ni | 3-6% |
| Mo | 0.5-1.5% |
| Cu | 0.4-1.0% |
| N | less than 0.1% |
| Nb | 0.1-0.24% |
| Fe | Balance |

and Creq/Nieq is 3-4.5

Ferrite content is 50-80%

7 Claims, 5 Drawing Figures

HIGH CR LOW NI TWO-PHASED CAST STAINLESS STEEL

This is a continuation, of application Ser. No. 189,335, filed Sept. 22, 1980, abandoned.

BACKGROUND OF THE INVENTION

This invention concerns with the high Cr low Ni two-phased cast stainless steel comprising mainly of ferrite phase and some amount of austenite phase blended in it.

High Cr low Ni ferrite-austenite two-phased cast stainless steel has such drawback that its toughness and corrosion resistance remarkably deteriorate relatively short time when it is heat treated at the temperatures ranging from 600° to 900° C., which is generally known as the sensitization phenomenon. Therefore this type of alloy is generally manufactured by the special melting method such as argon oxygen decarburization or vacuum oxygen decarburization method in order to restrict the amount of carbon to less than 0.03 percent and control the amount of gas such as nitrogen at minute quantity.

SUMMARY OF THE DISCLOSURE

The purpose of this invention is to furnish a cast stainless steel having satisfactory resistance against acid corrosion and less susceptibility to sensitization and high ductility.

The purpose of this invention is to furnish ferrite-austenite two-phased cast stainless steel having high toughness containing relatively high amount of carbon and nitrogen which may be manufactured by melting in the atmosphere, by adding appropriate amount of Nb to the high Cr low Ni two-phased stainless steel and by restricting the value of Cr eq/Ni eq within certain range such equivalent of Cr and equivalent of Ni representing the compounding effect to be determined by such basic components of stainless steel as Cr, Ni, Si and Mn.

DETAILED DESCRIPTION OF THE INVENTION

Figure 1:
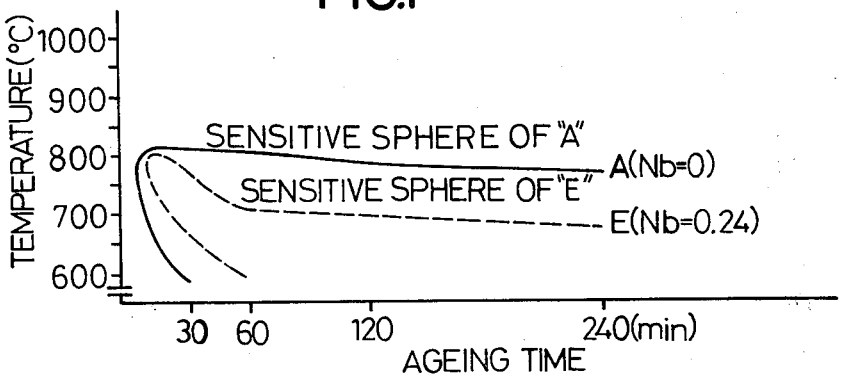
FIG. 1 is the graph to indicate sensitized zone of the steel covered by this invention.

The alloy covered by this invention has the following composition and the ranges of their contents are when expressed in weight percentage; C: 0.10% or less, Si: 1.5% or less, Mn: 1.5% or less, P: 0.04% or less, S: 0.04% or less, Cr: 22–30%, Ni: 3–6%, Mo: 0.5–1.5%, Cu: 0.4–1.0%, N: 0.1% or less, Nb: 0.1–0.24% and the balance substantially comprised of Fe and Cr eq./Ni eq. is 3–4.5 and the amount of ferrite is 50–80%.

Addition of C, Si and Mn is necessary but the amount of these components is sufficient if contained in the range normally found in this type of alloys and no lowest limit is necessary.

Same applies to the content of Al or Ca or both.

The contents of C, Si and Mn are those normally found in the ferrite type stainless steel and there is no particular characteristics in this regard with the alloy of this invention but as long as their contents are within the above-mentioned range, the alloy of this invention may be easily manufactured industrially by fusion in the furnace in the atmosphere.

The contents of P and S are preferred to be as little as possible but when melted in the atmosphere, 0.04% should be the maximum limit.

Cu is the element which improves corrosion resistance of stainless steel against non-oxidizing acid but its appropriate content is 0.4–1.0%. The effect of Cu is too small when its content is less than 0.4% but if it exceeds 1.0%, it separates as an impurity and it is undesirable from the view-point of corrosion resistance. Thus its content is restricted to 0.4–1.0%.

Ni and Cr are the important elements for stainless steel. It remarkably improves general corrosion resistance but to make the alloy two-phased alloy of ferrite-austenite, the appropriate amount of Ni is 3–6% to suit the content of Cr. In order to improve its resistance against corrosion by strong acid, amount of Cr is required to exceed 22 percent but at the percentage over 30%, castability and toughness of the alloy deteriorate. Thus its content is restricted to 22–30%.

Mo is an element which remarkably improves the resistance to local corrosion and its content is required to be 0.5–1.5%, because more than 1.5% is not economical. Thus its content is restricted to 0.5–1.5%.

As for N, the content of more than 0.1 percent deteriorates toughness and castability of the alloy and therefore its content is restricted to less than 0.1 percent.

Nb is the most important element in this invention as it remarkably improves corrosion resistance when it co-exists with Mo, Cr etc. that are the elements to produce ferrite and its effect to prevent sensitization is evident as shown in the example of contents to be stated later. It has been known since before that with austenite stainless steel, addition of Nb for the amount 8–10 times of the percentage of carbon improves the resistance to intergranular corrosion. It claimed to be because Nb fixes C in the form of NbC, prevents generation of Cr carbide in the grain boundary and thus prevents formation of Cr defficient layer. However in the case of ferrite-austenite two-phased stainless steel made mainly of ferrite as in the case of the steel of this invention, the concentrations of C and Nb are different between austenite phase and ferrite phase, and C is more abundantly distributed in austenite phase, while Nb is more abundant in ferrite phase. Therefore the weight ratio $Nb/C \approx 8$ as theoretically calculated for the case of straight austenite steel where C is fixed as NbC does not apply to the ferrite-austenite two-phased stainless steel and no definite answer has been given as to the appropriate contents of Nb for ferrite-austenite two-phased stainless steel.

In the case of the steel of this invention, the amount of Nb is restricted to 0.1–0.24 percent as it is known from the example of practice described below. The reason why its upper limit has been set at 0.24 percent is that the addition of Nb for more than 0.24 percent certainly gives better corrosion resistance but on the other hand impact strength tends to deteriorate and the desired impact value (3 $kg \cdot m/cm^2$ or better) is not obtained at the Nb content of more than 0.24 percent. In order to prevent such deterioration of impact strength, it may be effective to increase the amount of Nb but too large increase of Nb content will cause unbalance between the two phases, ferrite and austenite. Therefore to obtain the impact value of more than 3 kg·m/cm$^2$ with stability, the amount of Nb is restricted to be below 0.24 percent. If however Nb content is less than 0.1 percent, sensitization can not be prevented and corrosion resistance does not improve and therefore its lower limit is 0.1 percent.

Al and Ca are required to improve castability of steel. Either Al or Ca or both are added for the amount less than 0.1 percent. Since the addition of more than 0.1 percent does not give satisfactory effect, its upper limit is set at 0.1 percent.

Chemical compositions of various high Cr low Ni two-phased stainless steels are shown below. A–C are the steels for comparison and D–H are the steel of this invention.

| | | C | Si | Mn | P | S | Cr | Ni | Mo | Cu | N | Nb | Fe | Creq./ Nieq. | Ferrite (%) |
|---|---|---|---|---|---|---|---|---|---|---|---|---|---|---|---|
| Steel for com- | A | 0.08 | 0.99 | 0.86 | 0.022 | 0.013 | 23.01 | 5.0 | 0.5 | 0.51 | 0.03 | — | bal | 3.2 | 56 |
| parison | B | 0.07 | 0.97 | 1.16 | 0.020 | 0.012 | 2.42 | 4.9 | 0.8 | 0.84 | 0.04 | 0.53 | bal | 3.5 | 60 |
| Steel | C | 0.09 | 0.95 | 1.07 | 0.018 | 0.013 | 26.3 | 6.2 | 0.9 | 0.91 | 0.04 | 0.75 | bal | 3.1 | 55 |
| of this | D | 0.07 | 1.18 | 0.85 | 0.020 | 0.021 | 25.6 | 4.1 | 0.6 | 0.4 | 0.04 | 0.12 | bal | 4.2 | 75 |
| inven- | E | 0.06 | 1.05 | 0.82 | 0.019 | 0.022 | 25.5 | 5.1 | 0.6 | 0.5 | 0.03 | 0.24 | bal | 3.7 | 66 |
| tion | F | 0.08 | 1.10 | 0.87 | 0.021 | 0.020 | 23.4 | 5.2 | 0.7 | 0.5 | 0.03 | 0.22 | bal | 3.2 | 58 |
| | G | 0.06 | 1.08 | 0.85 | 0.018 | 0.020 | 26.5 | 4.5 | 0.7 | 0.4 | 0.03 | 0.23 | bal | 4.3 | 77 |
| | H | 0.06 | 1.02 | 0.75 | 0.020 | 0.023 | 24.0 | 3.8 | 0.7 | 0.5 | 0.04 | 0.20 | bal | 4.4 | 78 |

The amount of ferrite was determined by areal analysis in quantitative microscopy.

Creq.=Cr+Mo+1.5 Si+0.5 Nb(%)

Nieq.=Ni+0.5 Mn+30 C(%)

The aforesaid stainless steels were given solution heat treatment in which the steel is first heated at 1150° C. for 4 hrs followed by water cooling, and aging at 600°–1000° C. for 10–240 min. and the degree of their sensitization is evaluated by corrosion resistance test by immersing the specimens in 5% boiling sulfuric acid solution for 6 hrs. The degree of sensitization is expressed by the ratio of the amount of corrosion of aged specimen as against the amount of corrosion of the material given solution heat treatment. When the said ratio exceeds 3, the condition of the alloy is judged to be sensitized. FIG. 1 shows the example for reference obtained by this test method.

As it is known from the figure, the steel of this invention marked E which contains 0.24% of Nb has much narrower range of sensitization when compared to the steel A of Nb=0.

Figure 2:
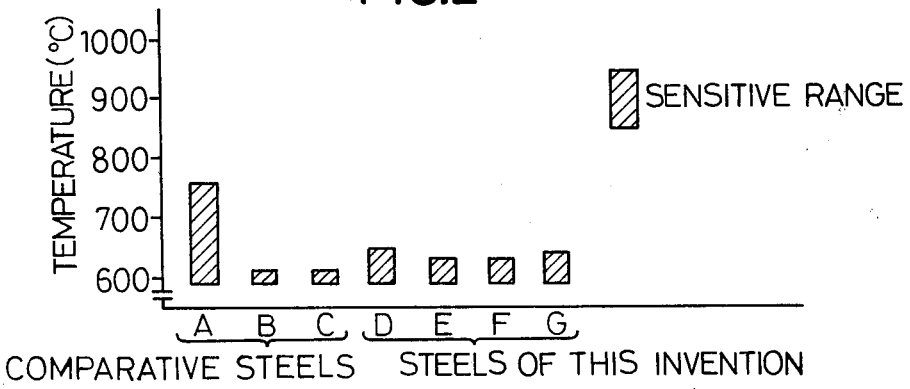
FIG. 2 is the graph to indicate sensitized zone of various ferrite-austenite two-phased stainless steel.

By using this method, sensitization ranges of various stainless steels indicated in the above table have been tested. FIG. 2 indicates the range of sensitization of various stainless steels held for 240 minutes under various temperature conditions, where lamellar type precipitation appears.

From this figure, it is known that the steel A of Nb=0 which is used for comparison has an extremely wide range of sensitization. As regards the steels containing Nb, the steel of this invention has somewhat wider range of sensitization when compared to the steels B and C which contain relatively large amount of Nb. It is because the amount of addition of Nb is restricted in the case of the steel of this invention to maintain the satisfactory impact strength. Yet its sensitization zone is sufficiently narrow from practical view-point when compared to steels B and C used for comparison.

Figure 3:
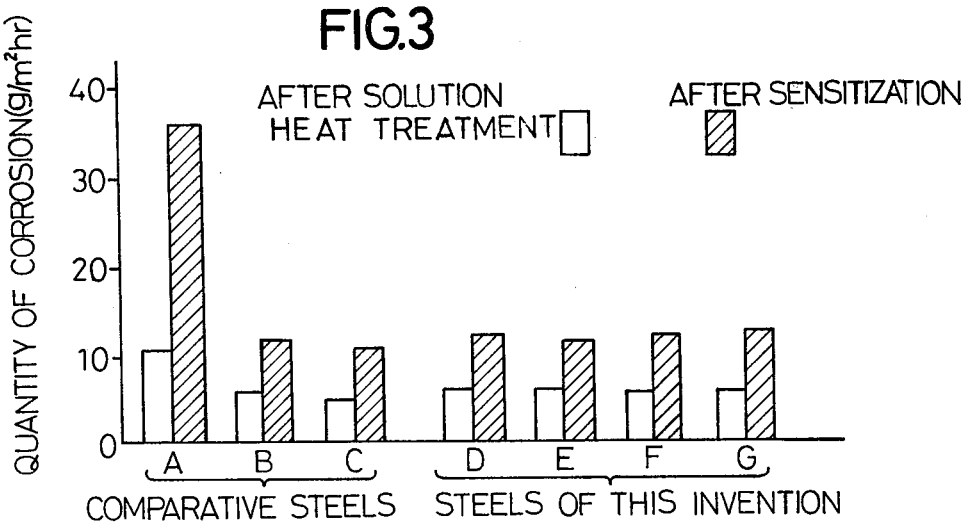
FIG. 3 is the graph to indicate corrosion resistance of various steels indicated in FIG. 2.

FIG. 3 shows the results of corrosion tests conducted on various stainless steels, given solution heat treatment shown in the aforesaid table and those which were immersed in 5% boiling sulfuric acid solution for 6 hrs. after sensitization for 45 min. at 700° C.

From this figure it is known that the corrosion resistance of the steel of this invention is excellent and deterioration of corrosion resistance due to sensitization is also less and its solution condition is not much different when compared to steel A. It appears to have no superiority to B and C but it is because the amount of addition of Nb is restricted in certain range to maintain the sufficient impact strength. As stated later, the steel of this invention has sufficient corrosion resistance.

Figure 4:
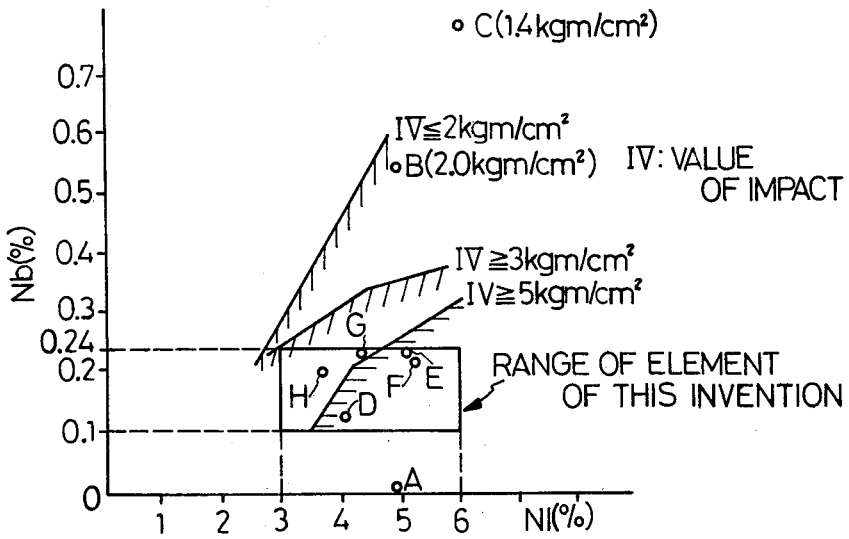
FIG. 4 is the graph to show impact strength changing with the amount of Ni and the amount of Nb.

FIG. 4 indicates the relation between the content of Nb and Ni, and the impact strength of the steel (by JIS No. 4 charpy impact strength test) which corresponds to ASTM E 23-82, Standard Method for Notched Bar Impact Testing of Metallic Materials. The figure shows that the impact strength tends to decrease with the increase of Nb content and therefore it is necessary to restrict the content of Nb at less than 0.24 percent to keep the balance between the contents of Nb and Nj while securing the desired impact strength (3 kg·m/cm$^2$). Therefore in this invention, the content of Nb is specifically restricted at less than 0.24 percent.

Figure 5:
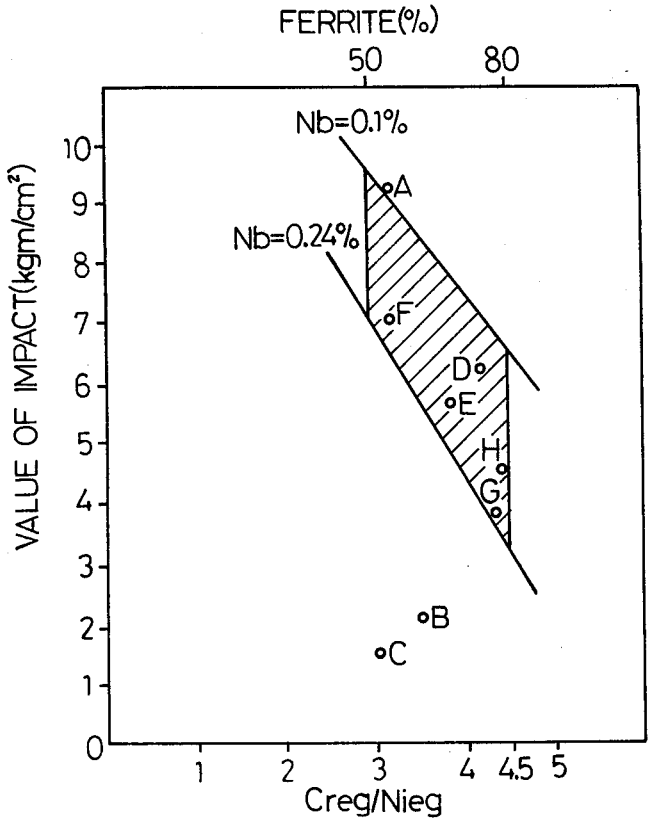
FIG. 5 is the graph to indicate the relation between Cr eq/Ni eq, impact strength and the content of ferrite(%).

The steel of this invention has the aforestated composition and its Creq/Nieq is set at 3–4.5. Hereunder is given the reason for it. Various elements of the steel of this invention give much better effect when used in combination than when they are used independently and in particular the combination of ferrite producing elements such as Cr, Mo, Si and Nb and austenite producing elements such as Ni, Mn and C is important to improve the toughness of ferrite-austenite two-phased stainless steel. The relations between composition and toughness after solution heat treatment are shown in FIG. 5. As the content of ferrite increases, its impact strength decreases and there is an inversed proportional relation between them. In FIG. 5, the content of ferrite is plotted on the axis of abscissas for reference.

As it is known from the Figure, the appropriate value of Creq./Nieq. is 3–4.5 and it is also necessary to set the amount of ferrite at 50–80 percent.

The amount of addition of Al and Ca may be an appropriate amount within the range stated earlier and if so the castability of stainless steel is greatly improved.

As detailed in the above in the case of the stainless steel of this invention, the composition of steel is set within the aforesaid range and the value of Creq/Nieq is set at 3–4.5 and the amount of ferrite is set at 50–80 percent and as the result, sensitization of steel is suppressed and the steel acquires an excellent resistance against corrosion by strong acid and an excellent impact strength or toughness and therefore it is highly suitable for the cast stainless steel to be used for the high toughness steel members for industrial use which are required to have both corrosion resistance and ductility.

What is claimed is:

1. A ferrite-austenitic two-phased cast stainless steel having an impact strength of at least 3 kg-m/cm$^2$ and containing the following (weight %):

| | |
|---|---|
| C | less than 0.10% |
| Si | less than 1.5% |
| Mn | less than 1.5% |
| P and S | less than 0.4% each |
| Cr | 22–30% |
| Ni | 3–6% |
| Mo | 0.5–0.9% |
| Cu | 0.4–1.0% |
| N | less than 0.1% |
| Nb | 0.1–0.24% |
| Fe | balance |

wherein values of Ni equivalent and Cr equivalent are calculated by the following equations:

Cr eq=Cr%+Mo%+1.5 Si%+0.5 Nb%

Ni eq=Ni%+0.5 Mn%+30 C%

Cr eq/Ni eq being 3 to 4.5 and ferrite content being 50 to 80%.

2. The stainless steel of claim 1 containing the following (weight %):

| | |
|---|---|
| C | 0.07% |
| Si | 1.18% |
| Mn | 0.85% |
| Cr | 25.6% |
| Ni | 4.1% |
| Mo | 0.6% |
| Cu | 0.4% |
| N | 0.04% |
| Nb | 0.12% |
| Fe | balance |

wherein the Cr eq/Ni eq is 4.2 and the ferrite content is 75%.

3. The stainless steel of claim 1 containing the following (weight %):

| | |
|---|---|
| C | 0.06% |
| Si | 1.05% |
| Mn | 0.82% |
| Cr | 25.5% |
| Ni | 5.1% |
| Mo | 0.6% |
| Cu | 0.5% |
| N | 0.03% |
| Nb | 0.24% |
| Fe | balance |

wherein the Cr eq/Ni eq is 3.7 and the ferrite content is 66%.

4. The stainless steel of claim 1 containing the following (weight %):

| | |
|---|---|
| C | 0.08% |
| Si | 1.10% |

-continued

| | |
|---|---|
| Mn | 0.87% |
| Cr | 23.4% |
| Ni | 5.2% |
| Mo | 0.7% |
| Cu | 0.5% |
| N | 0.03% |
| Nb | 0.22% |
| Fe | balance |

wherein the Cr eq/Ni eq is 3.2 and the ferrite content is 58%.

5. The stainless steel of claim 1 containing the following (weight %):

| | |
|---|---|
| C | 0.06% |
| Si | 1.08% |
| Mn | 0.85% |
| Cr | 26.5% |
| Ni | 4.5% |
| Mo | 0.7% |
| Cu | 0.4% |
| N | 0.03% |
| Nb | 0.23% |
| Fe | balance |

wherein the Cr eq/Ni eq is 4.3 and the ferrite content is 77%.

6. The stainless steel of claim 1 containing the following (weight %):

| | |
|---|---|
| C | 0.06% |
| Si | 1.02% |
| Mn | 0.75% |
| Cr | 24.0% |
| Ni | 3.8% |
| Mo | 0.7% |
| Cu | 0.5% |
| N | 0.04% |
| Nb | 0.20% |
| Fe | balance |

wherein the Cr eq/Ni eq is 4.4 and the ferrite content is 78%.

7. A ferrite-austenitic two-phased cast stainless steel having an impact strength of at least 3 kg-m/cm$^2$ and containing the following (weight %):

| | |
|---|---|
| C | less than 0.10% |
| Si | less than 1.5% |
| Mn | less than 1.5% |
| P and S | less than 0.04% each |
| Cr | 22–30% |
| Ni | 3–6% |
| Mo | 0.5–0.9% |
| Cu | 0.4–1.0% |
| N | less than 0.1% |
| Nb | 0.1–0.24% |
| Al or Ca or both | less than 0.1% |
| Fe | balance |

wherein values of Ni equivalent or Cr equivalent are calculated by the following equations:

Cr eq=Cr%+Mo%+1.5 Si%+0.5 Nb%

Ni eq=Ni%+0.5 Mn%+30 C%

Cr eq/Ni eq being 3 to 4.5 and ferrite content being 50 to 80%.

* * * * *